US012673803B2

(12) United States Patent
Eade

(10) Patent No.: US 12,673,803 B2
(45) Date of Patent: Jul. 7, 2026

(54) METAL PALLET ASSEMBLY

(71) Applicant: Gareth William Menzies, Maryborough West (AU)

(72) Inventor: Raymond Philip Eade, Maryborough West (AU)

(73) Assignee: Gareth Menzies, Maryborough (AU)

( * ) Notice: Subject to any disclaimer, the term of this patent is extended or adjusted under 35 U.S.C. 154(b) by 141 days.

(21) Appl. No.: 18/633,962

(22) Filed: Apr. 12, 2024

(65) Prior Publication Data

US 2024/0343442 A1 Oct. 17, 2024

(30) Foreign Application Priority Data

Apr. 12, 2023 (AU) ..... 2023901075

(51) Int. Cl.
*B65D 19/00* (2006.01)

(52) U.S. Cl.
CPC ..... *B65D 19/0095* (2013.01); *B65D 2519/00024* (2013.01); *B65D 2519/00059* (2013.01); *B65D 2519/00273* (2013.01); *B65D 2519/00293* (2013.01); *B65D 2519/00323* (2013.01)

(58) Field of Classification Search
CPC ..... B65D 19/0095; B65D 2519/00024; B65D 2519/00059; B65D 2519/00273; B65D 2519/00392; B65D 2519/00323; B65D 2519/00094; B65D 2519/00129; B65D 2519/00298; B65D 2519/00333; B65D 2519/00373; B65D 2519/00407; B65D 2519/00562; B65D 2519/00572; B65D 2519/00567; B65D 2519/00293; B65D 2519/00432
USPC ..... 108/51.11, 56.1, 56.3, 57.17, 57.18, 108/59.19, 57.22, 57.29, 57.32, 57.33, 108/57.19
See application file for complete search history.

(56) References Cited

U.S. PATENT DOCUMENTS 3,405,666 A * 10/1968 Miller ..... B65D 19/0038 108/57.1
3,602,157 A * 8/1971 Cohen ..... B65D 19/0095 108/57.1
4,077,334 A * 3/1978 Svirklys ..... B65D 19/0097 52/579

(Continued)

FOREIGN PATENT DOCUMENTS

BE 865597 A * 7/1978 ..... B65D 19/0095
CA 1071552 A * 2/1980 ..... B65D 19/0097

(Continued)

OTHER PUBLICATIONS

JPS61502741 English translation (Year: 1986).*

*Primary Examiner* — Janet M Wilkens
(74) *Attorney, Agent, or Firm* — Workman Nydegger

(57) ABSTRACT

A metal pallet comprising: a load receiving top deck comprising a plurality of elongate and profiled top deck members extending across an overall length of the pallet between first and second ends of the pallet, a bottom deck adapted to be supported on a supporting surface or supporting and lifting equipment, the bottom deck comprising a plurality of elongate and profiled bottom deck members; a plurality of substantially parallel and spaced apart elongate stringer members positioned transversely and in between the top deck and the bottom deck.

16 Claims, 11 Drawing Sheets

(56) References Cited

U.S. PATENT DOCUMENTS

| | | | | | |
|---|---|---|---|---|---|
| 4,145,976 | A * | 3/1979 | Svirklys | B65D 19/0095 403/231 |
| 4,382,414 | A * | 5/1983 | Svirklys | B65D 19/0097 24/294 |
| 4,485,744 | A * | 12/1984 | Umemura | B65D 19/0095 108/57.18 |
| 5,440,998 | A * | 8/1995 | Morgan, IV | B65D 19/0048 108/901 |
| 5,941,179 | A * | 8/1999 | Herring | B65D 19/0095 108/56.3 |
| 2002/0078863 | A1* | 6/2002 | Marr | B65D 19/0048 108/57.32 |
| 2007/0245932 | A1* | 10/2007 | Nielsen | B65D 19/0093 108/51.11 |
| 2011/0192327 | A1* | 8/2011 | Nordstrom | B65D 19/12 108/57.32 |

FOREIGN PATENT DOCUMENTS

| | | | | |
|---|---|---|---|---|
| CZ | 211493 | A3 * | 5/1994 | B65D 19/0095 |
| JP | S61502741 | * | 11/1986 | |
| JP | 2000072146 | A * | 3/2000 | |
| KR | 101288393 | B1 * | 7/2013 | B65D 19/00 |
| KR | 102003524 | B1 * | 7/2019 | B65D 19/0093 |
| NZ | 190748 | A * | 7/1983 | B65D 19/0095 |
| WO | WO-9214654 | A1 * | 9/1992 | B65D 19/0093 |
| WO | WO-2013085461 | A1 * | 6/2013 | B65D 19/0095 |

* cited by examiner

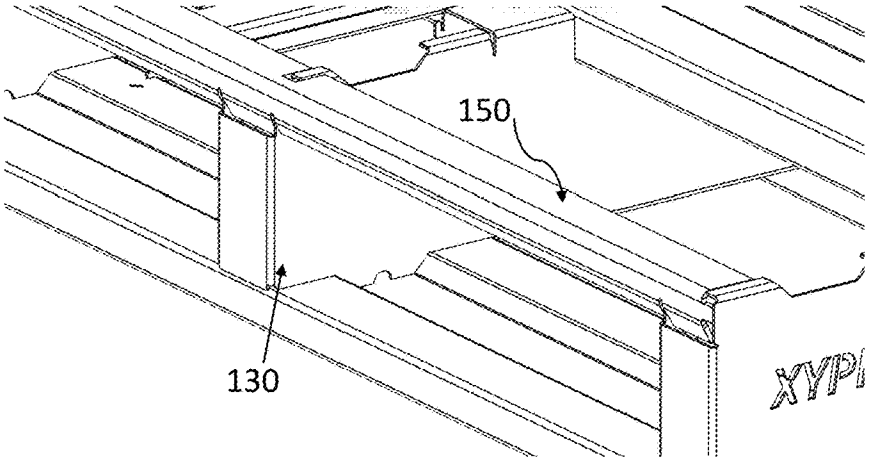
FIGURE 8A
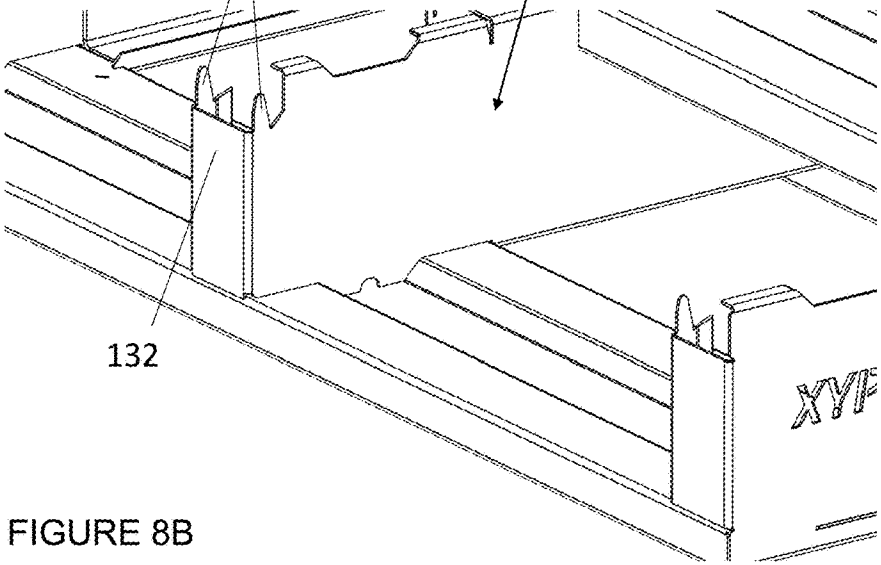
FIGURE 8B
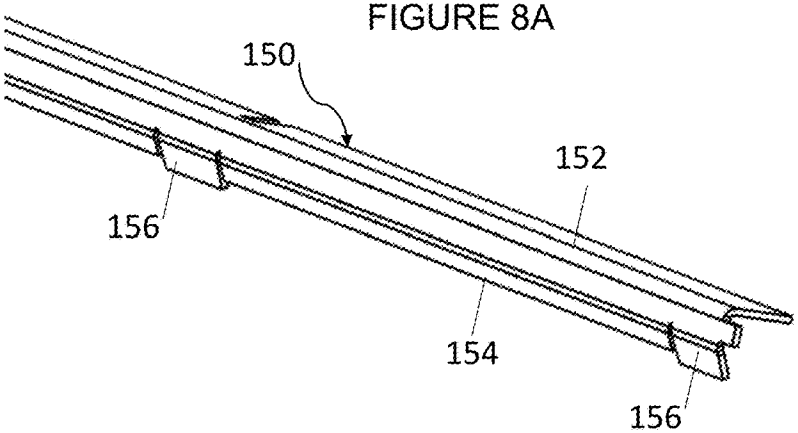

METAL PALLET ASSEMBLY

TECHNICAL FIELD

The present invention relates to pallets for supporting freight, goods or other materials. More particularly, the invention relates to a pallet made of metal.

BACKGROUND

Any references to methods, apparatus or documents of the prior art are not to be taken as constituting any evidence or admission that they formed, or form part of the common general knowledge.

Conventionally, pallets have been made from wood. Wood pallets are heavy and subject to warpage, splintering and splitting. Furthermore, wood pallets are not fire-proof. To overcome the disadvantages found in wood pallets, pallets have been also made from plastic. Plastic pallets require a large amount of resin to be made such that they are of sufficient strength to support freight and goods. Furthermore, plastic pallets are also not fireproof.

Metal pallets have been made to overcome the shortcomings of wood and plastic pallets. In the past, metal pallets were manufactured as welded metal sections or metal pipe constructions or of deep-drawn components and metal sections. As a rule, the welded metal constructions have a high weight and are very difficult and complicated to manufacture. The lightweight constructions of deep-drawn components usually results in low structural strength and they can be difficult to stack and to transport. It is therefore desirable to provide an improved metal pallet which at least addresses some of the issues of the prior art.

SUMMARY OF INVENTION

In an aspect, the invention provides a metal pallet comprising:

- a load receiving top deck comprising a plurality of elongate top deck members extending across an overall length of the pallet between first and second ends of the pallet,
- a bottom deck adapted to be supported on a supporting surface or supporting equipment, the bottom deck comprising a plurality of elongate bottom deck members;
- a plurality of substantially parallel and spaced apart elongate stringer members positioned transversely and in between the top deck and the bottom deck.

In an embodiment, the top deck members and/or the bottom deck members are profiled.

In an embodiment, the top deck comprises edge deck members located at the first and second ends of the pallet to define a width of the pallet with one or more additional top deck members between the edge top deck members, the edge top deck members being positioned above respective end portions of the stringers.

In an embodiment, the edge deck member comprises a roll formed metal panel having a panel length extending between two panel ends and a panel width extending between two lateral sides of the metal panel with at least one downwardly depending C-shaped channel extending along one of the opposed lateral sides of the top deck member.

In an embodiment, the C-shaped channel further comprises an upwardly bent end section extending along the length of the C-shaped channel.

In an embodiment, the metal pallet further comprises at least one edge reinforcement member, said edge reinforcement member being configured for being positioned within said C-shaped channel of the edge deck member for effecting engagement with an underside portion of the edge deck member and the respective end portions of the stringers.

In an embodiment, the edge reinforcement member comprises: a first elongate portion that engages with an underside portion of a top surface of the edge deck member; and a second dependent elongate portion extending downwardly from the first elongate portion for engagement with an inner surface of the C-shaped channel.

In an embodiment, the second dependent elongate portion further comprises engagement tabs for engagement with end walls of the stringers.

In an embodiment, the end portions of the stringers comprises: upwardly projecting guiding members configured for being received into guiding apertures provided in walls defining the C-shaped channel of the edge deck member.

In an embodiment, each of said additional deck members also comprises a roll formed metal panel having a panel length extending between two panel ends and a panel width extending between two lateral sides of the metal panel with at least one downwardly depending C-shaped channel extending along the opposed lateral sides of the top deck member.

In an embodiment, the intermediate portions of the stringers comprise engagement portions for receiving and engaging the opposed C-shaped channels of the additional deck members.

In an embodiment, the metal pallet further comprises one or more stringer reinforcing members extending along and reinforcing one or more corresponding stringers.

In an embodiment, the stringer reinforcing member comprises a top section spaced away from a bottom section, the top and bottom sections having respective first and second ends with the top and bottom sections extending along the length of the stringer when attached to an intermediate portion of the stringer located between the end portions of the stringer.

In an embodiment, the top and bottom sections are joined by one or more joining sections extending between the top and bottom sections.

In an embodiment, the top section comprises an arched configuration extending between the two ends of the stringer reinforcing member.

In an embodiment, the bottom section also comprises an arched section extending between two feet portions of the stringer reinforcing member.

In an embodiment, at least one of said stringers extend under an inner region of the top deck that is located away from a peripheral region of the top deck, to support a load positioned on the central region of the top deck wherein the stringer reinforcing member is fastened to the one of said stringers extending under the inner region.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 8A illustrates an assembled view of the reinforcement member 150 as assembled on the metal pallet 100 (with edge deck member 112A removed).

FIG. 8B illustrates an exploded view of the reinforcement member 150 isoalted from the metal pallet 100 (with edge deck member 112A removed).

DETAILED DESCRIPTION OF PREFERRED EMBODIMENTS

Figure 1:
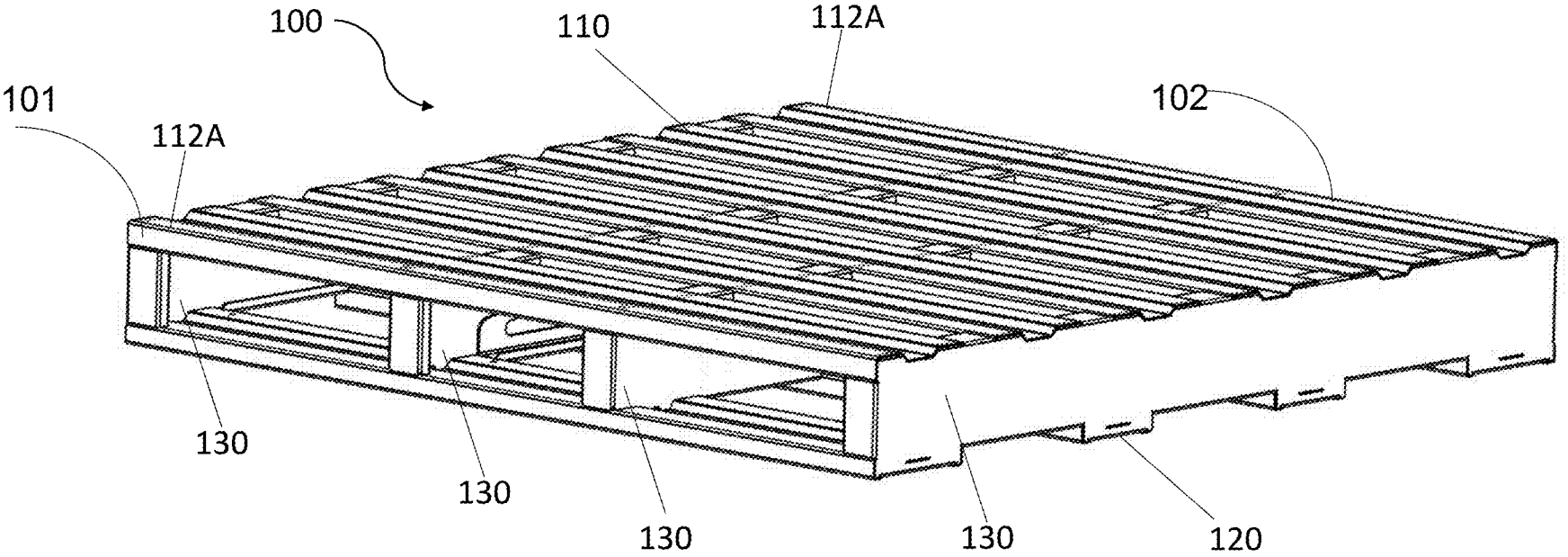
FIG. 1 is a side perspective view of a metal pallet 100 in accordance with a preferred embodiment.

FIGS. 1 to 10 illustrate a preferred embodiment of a metal pallet 100. The metal pallet comprises a load receiving top deck 110 with a plurality of profiled top deck members generally represented by reference numeral 112. The metal pallet 100 also comprises a bottom deck 120 that is adapted to be positioned and supported on a supporting structure such as a pallet rack or an underlying supporting surface. The bottom deck 120 also comprises elongate and profiled bottom deck members 122. A plurality of substantially parallel and spaced apart stringer members 130 are positioned transversely and in between the top deck 110 and the bottom deck 120.

Figure 1B:
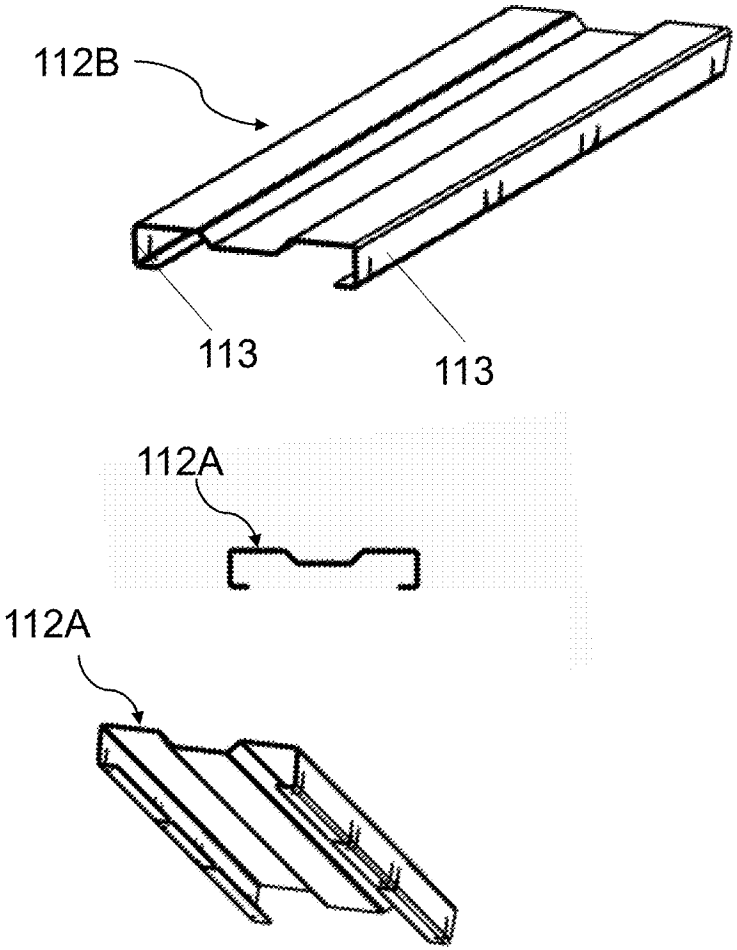
FIG. 1B illustrates top perspective view, end view and bottom perspective view of a top deck member 112B.
Figure 1A:
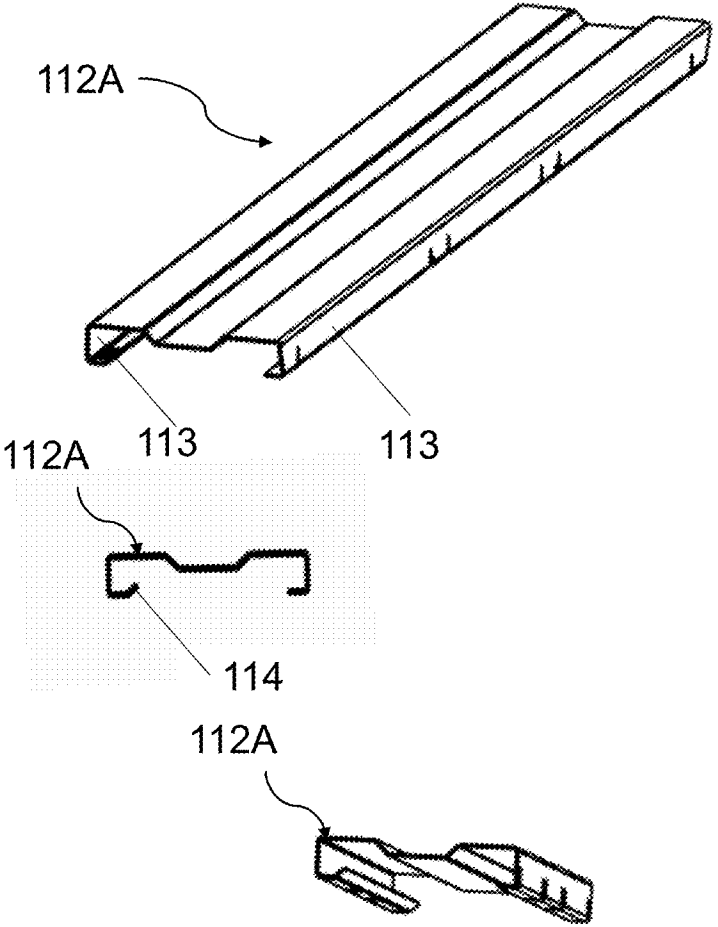
FIG. 1A illustrates a top perspective view, end view and bottom perspective view of an edge deck member 112A.
Figure 2:
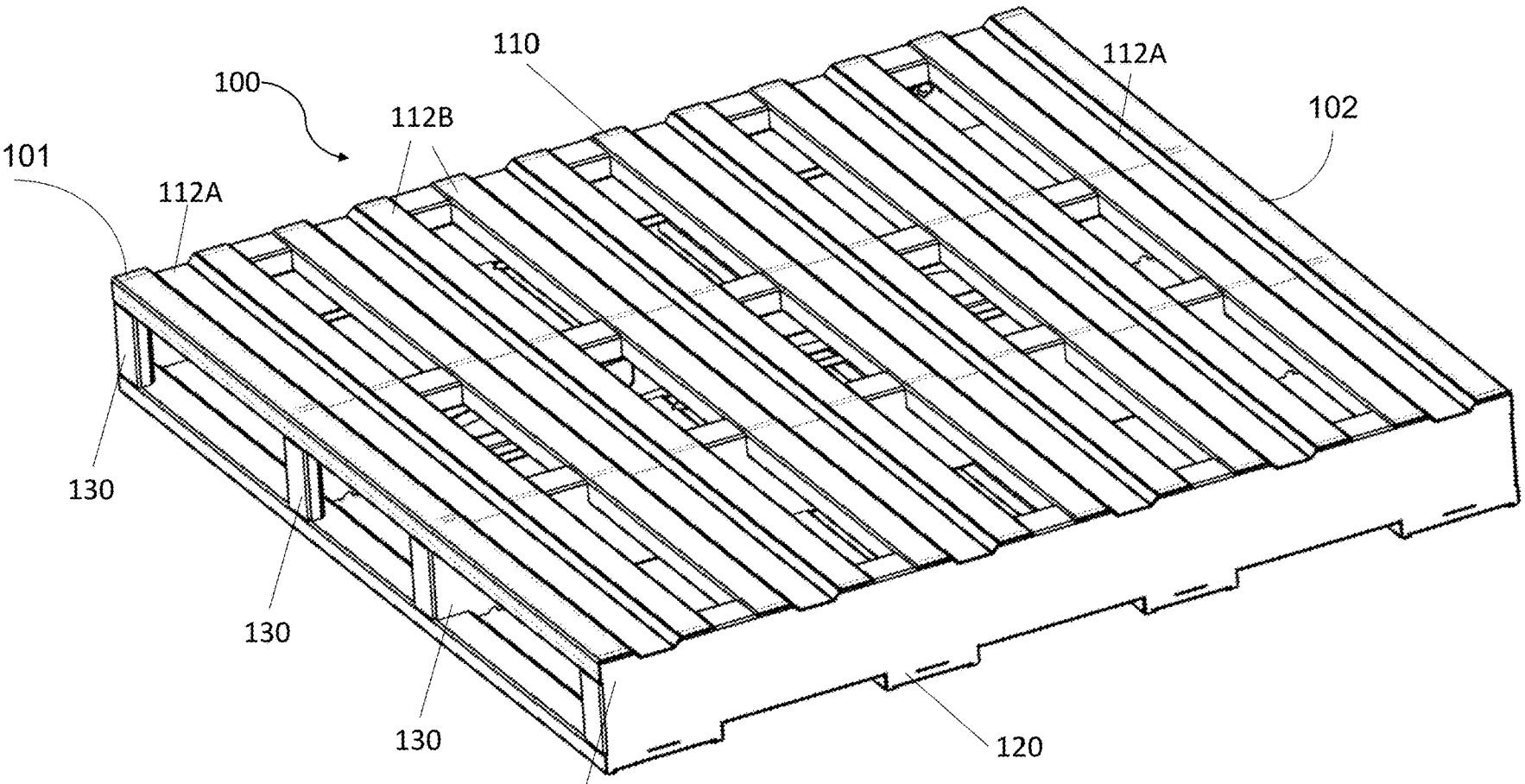
FIG. 2 is a top perspective view of the metal pallet 100.
Figure 3:
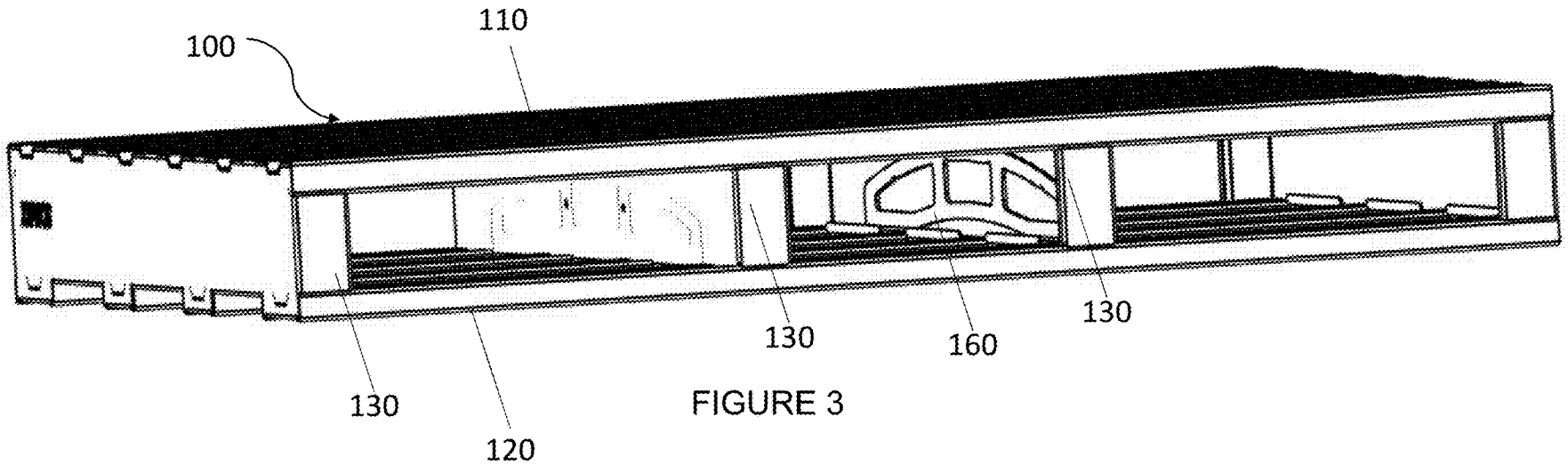
FIGS. 3 and 4 illustrate side views of the metal pallet 100.
Figure 4:
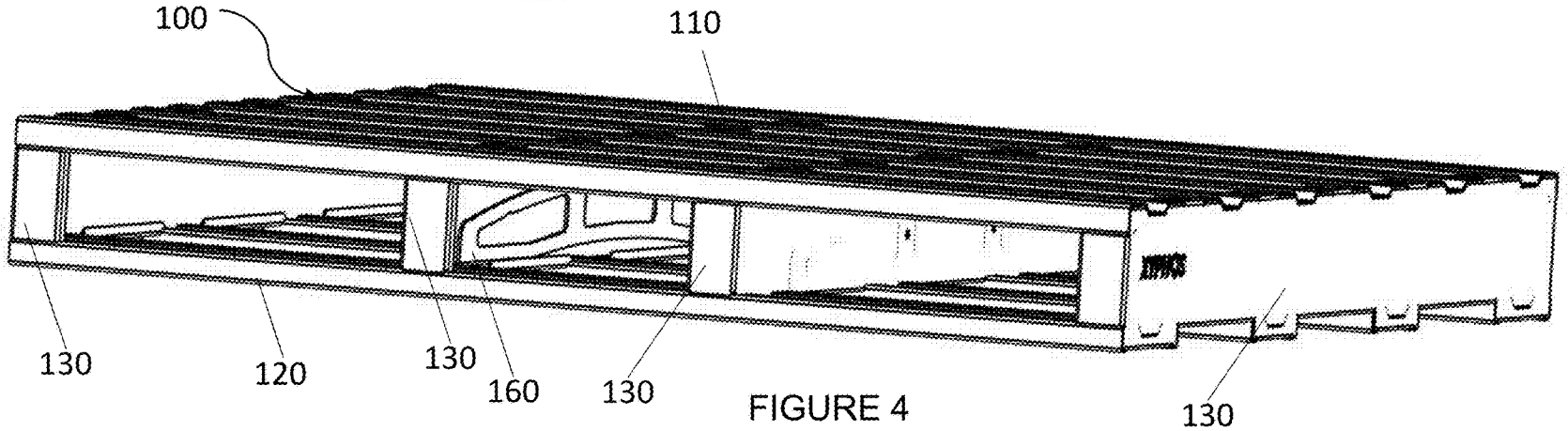
Figure 5:
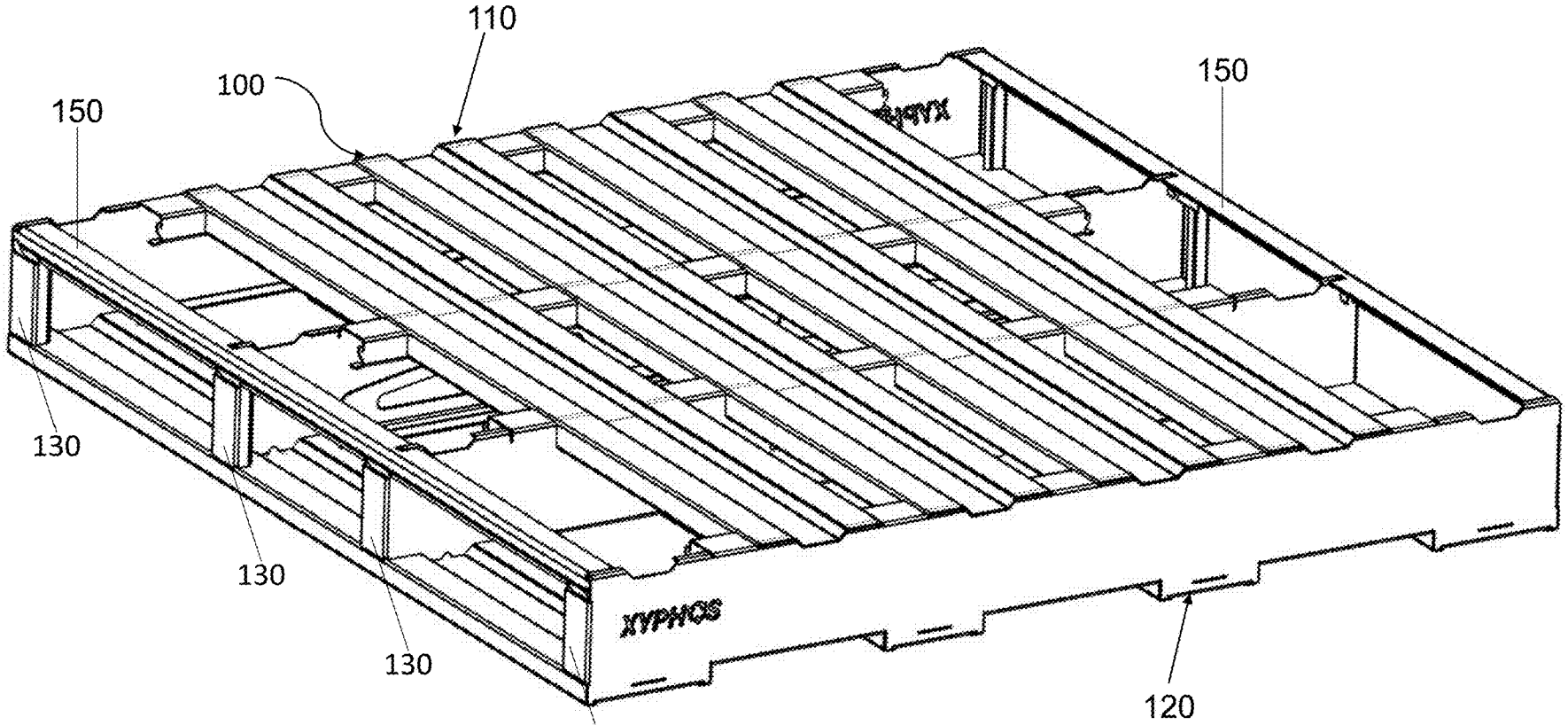
FIG. 5 illustrates a top perspective view, end view and bottom perspective view of the metal pallet 100 with the edge deck members 112A removed.

The top deck 110 comprises two types of profiled top deck members that have been generally represented by 112. The top deck 110 comprises profiled edge deck members 112A located at the first and second ends 101 and 102 of the pallet 100 with additional deck members 112B being positioned between the edge deck members 112A. The top deck members 112 as shown in FIGS. 1A and 1B are formed from sheet metal with a generally corrugated profile having flattened crest portions extending along lateral sides of the top deck members 112 separated by a trough portion. As shown in FIGS. 1A and 1B, the deck members 112A comprise a roll formed metal panel having a panel length extending between two panel ends and a panel width extending between two lateral sides of the metal panel downwardly depending C-shaped channels 113 extending along each of the opposed lateral sides of the top deck members 112. The edge deck members 112A are positioned above the respective end portions of the stringers 130. The engagement between the deck members 112A, 112B and the stringers 130 will be discussed in further detail.

The only difference between the edge top deck member panel 112A when compared with the additional top deck members 112B is the provision of an upwardly bent retaining lip 114 that is provided on the outer lateral C-shaped channel. The function of the retaining lip 114 will become evident in the foregoing sections. The top deck members 112 are arranged with relatively small gaps in between adjacently arranged deck members 112 to maximise a loading surface for the pallet 100. In some further embodiments, the top deck members 112 may be arranged without any gaps to provide a substantially gap free loading surface for the top deck 110 of the metal pallet 100.

The bottom deck 120 also comprises bottom deck members 122 which comprises a substantially identical profile as top deck panels 112B. Unlike the top deck 110, the bottom deck 120 comprises substantive gaps between bottom deck members 122 to allow the pallet to be positioned and supported on a pallet rack (not shown) by receiving the pallet rack members in the gaps.

Figure 6:
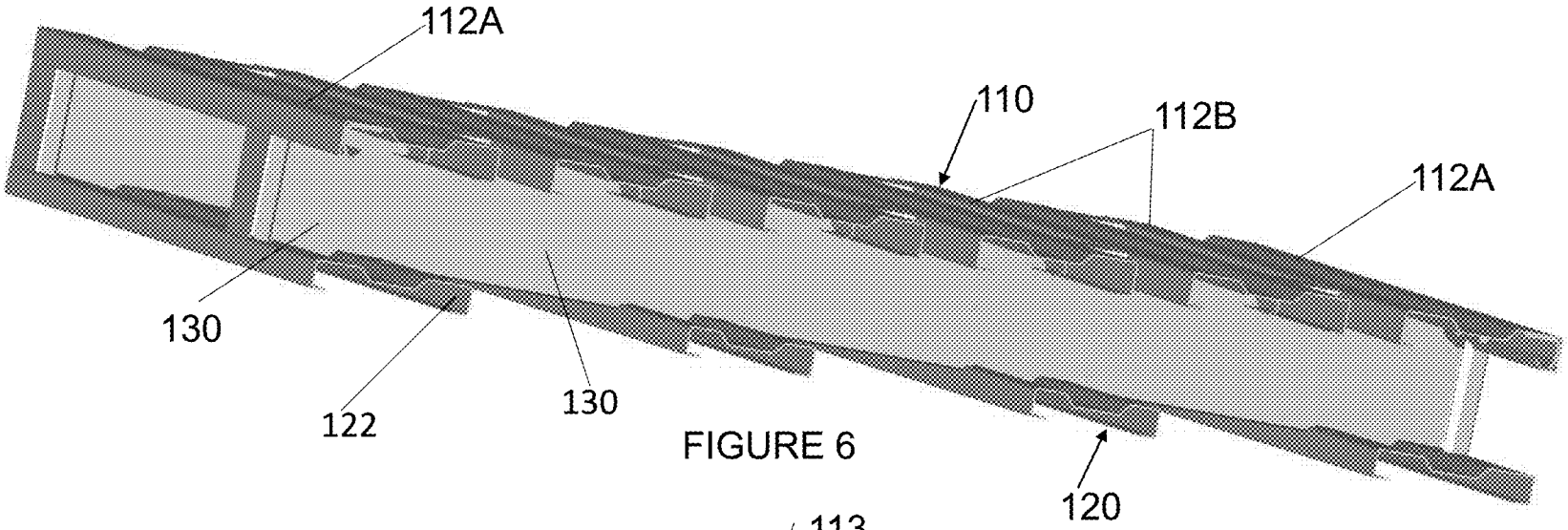
FIG. 6 is a sectional perspective view of the metal pallet 100.
Figure 7:
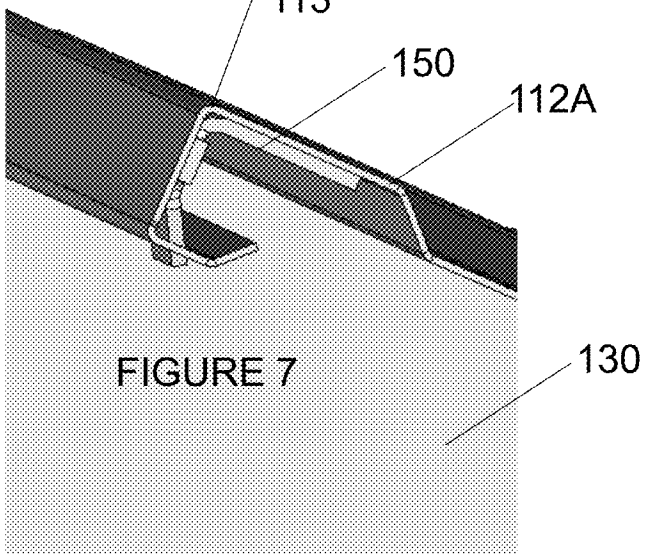
FIG. 7 is an enlarged view of an end portion of the metal pallet 100.

Advantageously, the pallet 100 comprises edge reinforcement members 150 that are adapted to be positioned within the outwardly located C-channel that is located below the edge portions of the top deck 110 extending along the first and second ends of the top deck 110. The reinforcement edge member 150 is positioned in the outwardly located C-channel 113 to effect engagement between the underside portion of the edge deck member 112A and the end portions of the stringers 130. FIG. 6 is a top perspective view of the metal pallet in which the edge deck members 112A have been removed to show the location of the edge reinforcement member 150. FIGS. 7A and 7B illustrate sections views depicting the location of the edge reinforcement member 150 within the outwardly C-channel 113 for the edge deck member 112A.

FIGS. 8A and 8B are enlarged perspective views for the edge portion of the metal pallet 100. Once again, in both views, the edge deck member 112A has not been shown for ease of understanding. Each of the edge reinforcement members 150 comprises: a first elongate portion 152 that engages with an underside portion of a top surface of the edge deck member. The edge reinforcement member 150 also includes a second dependent elongate portion 154 extending downwardly from the first elongate portion 152 for engagement with an inner surface of the C-shaped channel. The second dependent elongate portion 154 further comprises engagement tabs 156 for engagement with end walls 132 of the stringers 130. The end portions of the stringer 130 comprises guiding nibs 134 that can be received into apertures provided within the outwardly located C-shaped channel 113 which retains the reinforcement member 150. The first elongate portion 152 of the edge reinforcement member 150 may be seam welded to the underside of the edge deck member 112A. Portions of the second dependent portion 154 may also be seam welded to end portions of the stringers 130. The reinforcement members 150 located along the edge portions of the metal pallet 100 provide much needed additional mechanical strength for lashings or strapping that is typically tied down to the edge decking member 112A. The additional reinforcement provided by the reinforcement members 150 prevents failure of the edge decking members 112A during use.

Figure 9:
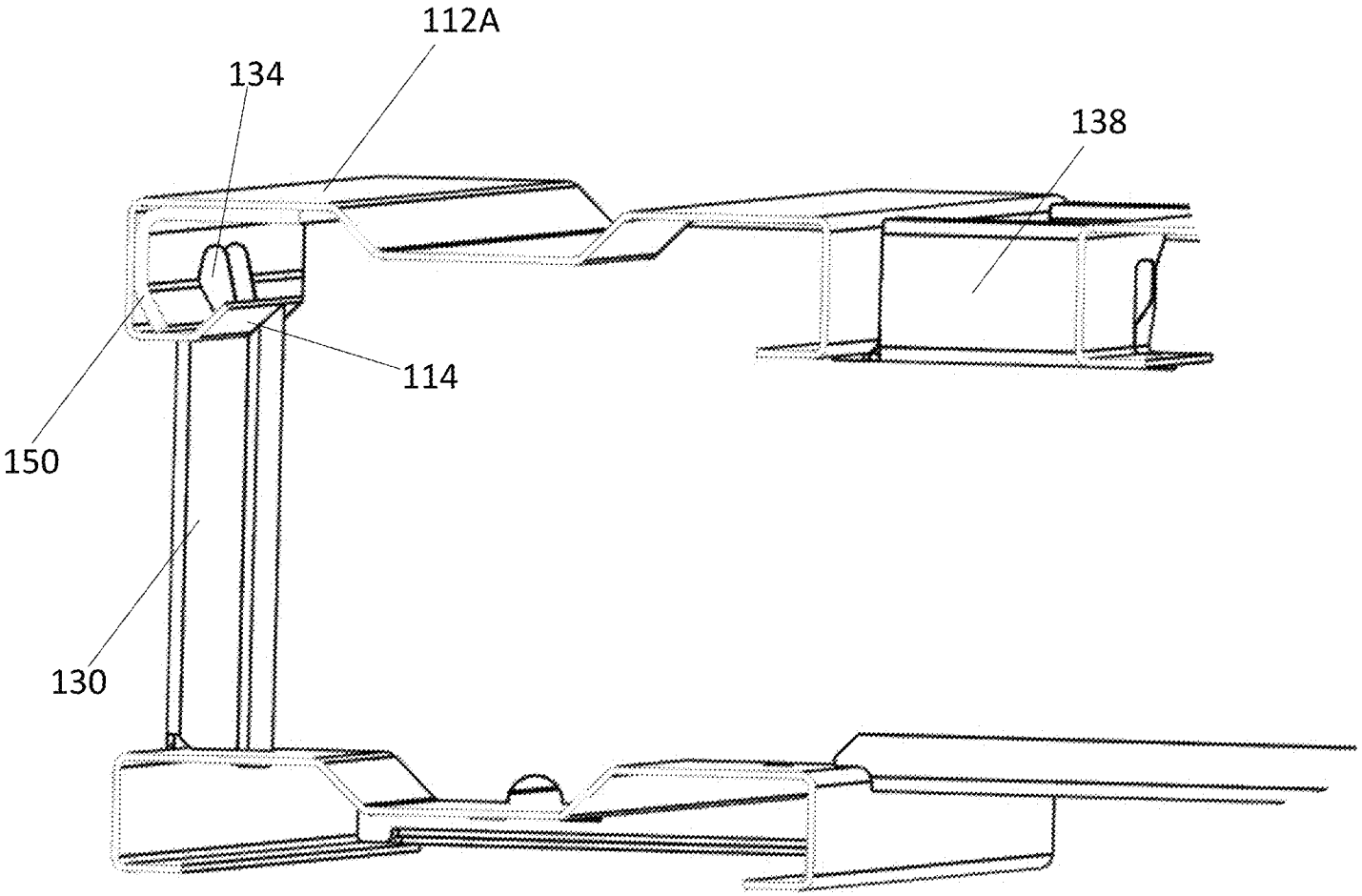
FIG. 9 is an enlarged sectional view of the metal pallet 100.
Figure 10:
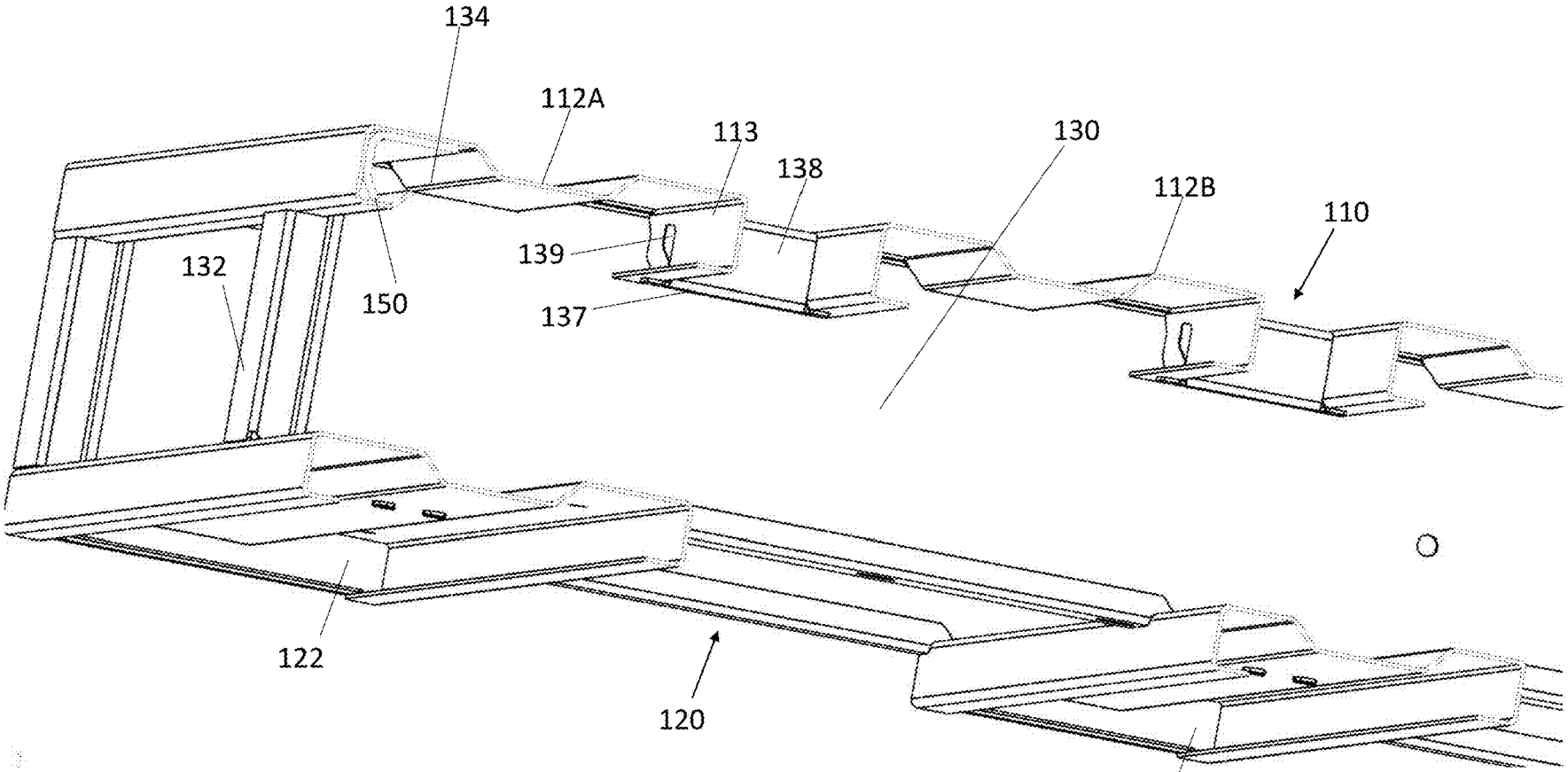
FIG. 10 is a partial view of the metal pallet 100.
Figure 11A:
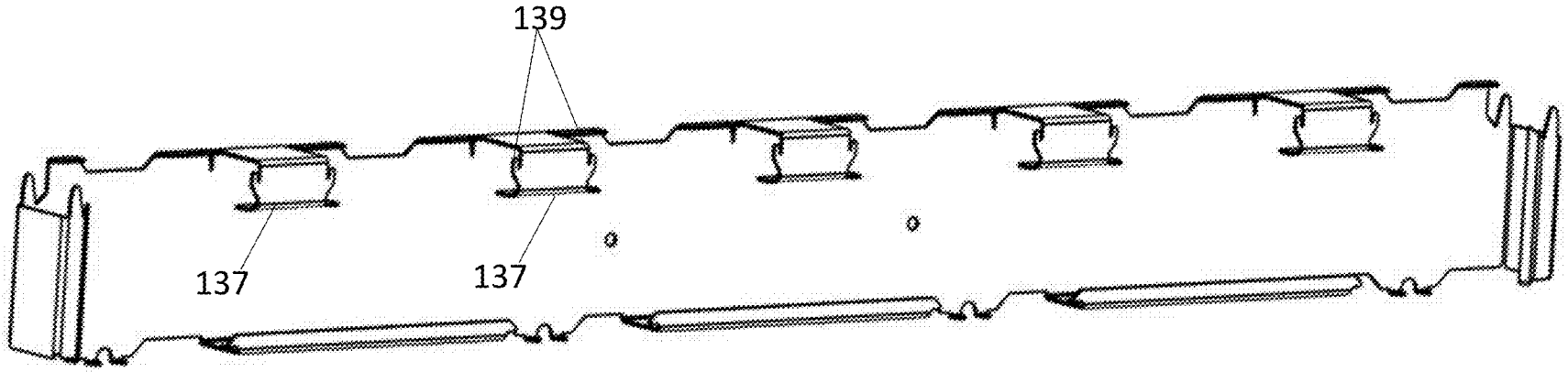
FIGS. 11A and 11B illustrate perspective views of stringers 130.
Figure 11B:
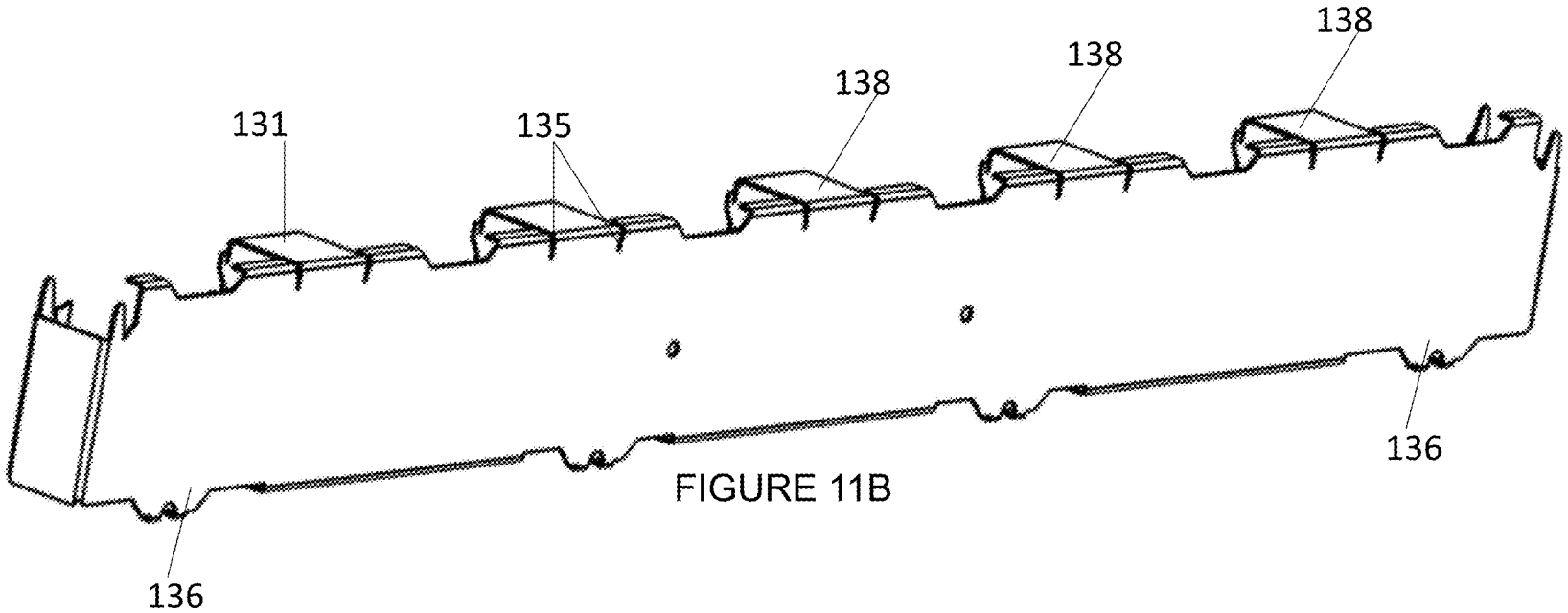

Referring to FIGS. 9 to 11, each stringer 130 comprises a plurality of top deck supporting formations 138 to support and attach the top deck members 112 thereon. Specifically each of these formations 133 comprises two opposed slits 135, each slit 135 being sufficiently large to receive a thickness of the vertical wall defining the channel 113. The formations 138 also include channel supports 137 for engaging and supporting the horizontal wall defining the channel 113 for the profiled top deck members 112. Additional guiding nibs 139 are also provided which are configured to be received into apertures provided in the vertical wall of the channels 113 to position the vertical wall within the slit 135. The top deck supporting formations 138 also include a top surface 131 for engaging with an underside of the top deck members 112. It would also be understood that the underside portions and outer surfaces of the channel 113 for the top deck members 112 may be spot welded or seam welded to portions of the engagement formations 138 of the stringer 130.

Each stringer 130 also comprises bottom deck engagement formations 136 that are adapted to receive bottom deck members 122. The bottom deck engagement formations 136 comprises tabs that can be received into apertures in the bottom deck members 122 and subsequently bent to fasten a plurality of bottom deck members with each of the stringers 130.

Figure 12A:
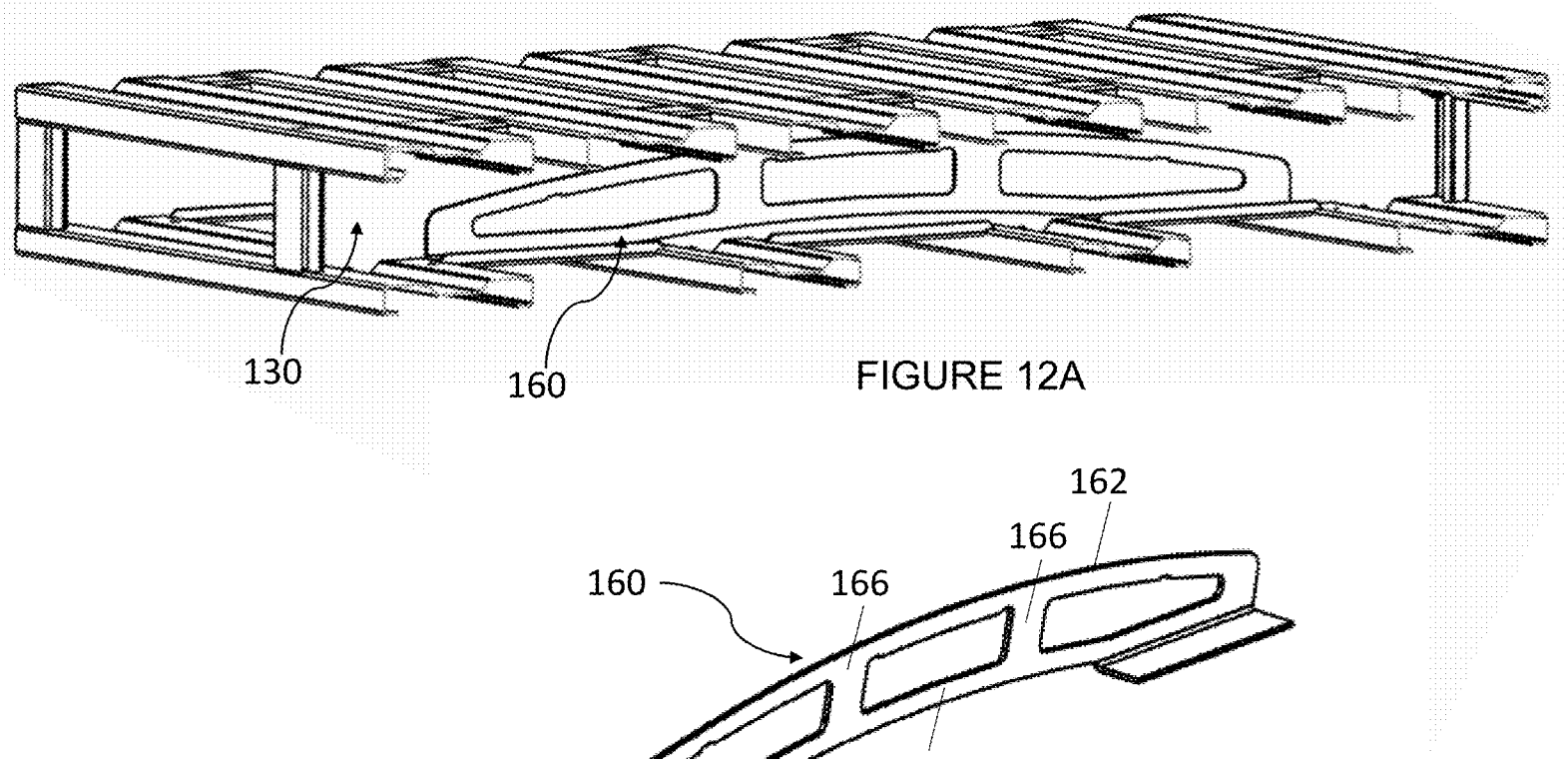
FIG. 12A shows a partial sectional view of the metal pallet 100.
Figure 12B:
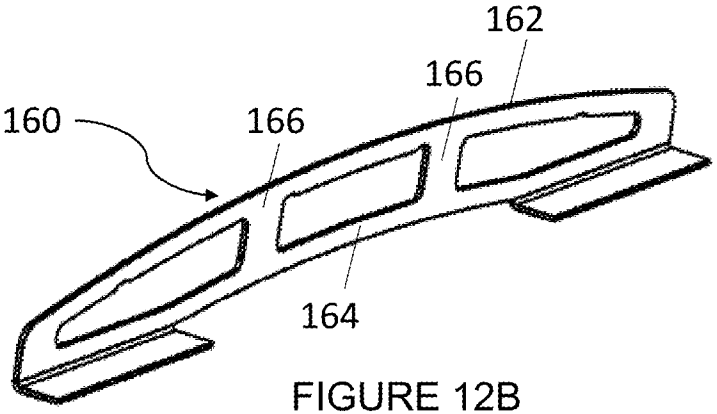
FIG. 12B illustrates an isolated view of a stringer reinforcement member 160.

Referring to FIGS. 12A and 12B, stringers 130 may be reinforced by stringer reinforcement members 160 that extend along the length of the stringers 130. The stringer reinforcing member 160 comprises a top section 162 spaced away from a bottom section 164. The top and bottom sections 162 and 164 have respective first and second ends with the top and bottom sections 162 and 164 extending along the length of the stringer when attached to an intermediate portion of the stringer 130 located between the end portions of the stringer 130. The top and bottom sections 162 and 164 are joined by joining sections 166. Each of the top and bottom sections 162 and 164 comprises arched sections extending between the two ends of the stringer reinforcing member 160. The stringer reinforcing member 160 also comprises feet for engaging the bottom deck members 122. The stringer reinforcing members 160 are located alongside stringers 160 that extend across and below the inner central portion of the top deck 110 to support a static load on the top deck 110 in a situation such as when the loaded pallet is positioned on a pallet rack. The provision of the stringer reinforcements helps in preventing point loading of the stringers 130 passing through the central region and assists in distributing the load across the entire length of the stringers 130.

In compliance with the statute, the invention has been described in language more or less specific to structural or methodical features. The term "comprises" and its variations, such as "comprising" and "comprised of" is used throughout in an inclusive sense and not to the exclusion of any additional features.

It is to be understood that the invention is not limited to specific features shown or described since the means herein described comprises preferred forms of putting the invention into effect.

The invention is, therefore, claimed in any of its forms or modifications within the proper scope of the appended claims appropriately interpreted by those skilled in the art.

The invention claimed is:

1. A metal pallet comprising:

a load receiving top deck comprising a plurality of elongate top deck members extending across an overall length of the pallet between first and second ends of the pallet, a bottom deck adapted to be supported on a supporting surface or supporting equipment, the bottom deck comprising a plurality of elongate bottom deck members; and a plurality of substantially parallel and spaced apart elongate stringer members positioned transversely and in between the top deck and the bottom deck, wherein the top deck comprises edge deck members each comprising at least one downwardly depending C-shaped channel extending along a lateral side of each edge deck member, wherein the pallet further comprises at least one edge reinforcement member, said edge reinforcement member being configured for being positioned within said C-shaped channel of the edge deck member for effecting engagement with an underside portion of the edge deck member and the respective end portions of the stringer members.

2. The metal pallet in accordance with claim 1 wherein the edge deck members are located at the first and second ends of the pallet to define a width of the pallet with one or more additional top deck members between the edge top deck members, the edge top deck members being positioned above respective end portions of the stringer members.

3. The metal pallet in accordance with claim 1 wherein the edge deck member comprises a roll formed metal panel having a panel length extending between two panel ends and a panel width extending between two lateral sides of the metal panel.

4. The metal pallet in accordance with claim 1 wherein the C-shaped channel further comprises an upwardly bent end section extending along the length of the C-shaped channel.

5. The metal pallet in accordance with claim 1 wherein the edge reinforcement member comprises:

a first elongate portion that engages with an underside portion of a top surface of the edge deck member; and a second dependent elongate portion extending downwardly from the first elongate portion for engagement with an inner surface of the C-shaped channel.

6. The metal pallet in accordance with claim 5 wherein the second dependent elongate portion further comprises engagement tabs for engagement with end walls of the stringer members.

7. The metal pallet in accordance with claim 1 wherein the end portions of the stringer members comprises upwardly projecting guiding members configured for being received into guiding apertures provided in walls defining the C-shaped channel of the edge deck member.

8. The metal pallet in accordance with claim 1 wherein additional deck members comprises a roll formed metal panel having a panel length extending between two panel ends and a panel width extending between two lateral sides of the metal panel with at least one downwardly depending C-shaped channel extending along the opposed lateral sides of the top deck member.

9. The metal pallet in accordance with claim 8 wherein intermediate portions of the stringer members comprise engagement portions for receiving and engaging the opposed C-shaped channels of the additional deck members.

10. The metal pallet in accordance with claim 1 further comprising one or more stringer reinforcing members extending along and reinforcing one or more corresponding stringer members.

11. The metal pallet in accordance with claim 10 wherein the stringer reinforcing member comprises a top section spaced away from a bottom section, the top and bottom sections having respective first and second ends with the top and bottom sections extending along the length of the stringer member when attached to an intermediate portion of the stringer member located between the end portions of the stringer member.

12. The metal pallet in accordance with claim 11 wherein the top and bottom sections are joined by one or more joining sections extending between the top and bottom sections.

13. The metal pallet in accordance with claim 11 wherein the top section comprises an arched configuration extending between the two ends of the stringer reinforcing member.

14. The metal pallet in accordance with claim 11 wherein the bottom section also comprises an arched section extending between two feet portions of the stringer reinforcing member.

15. The metal pallet in accordance with claim 10 wherein at least one of said stringer members extend under an inner region of the top deck that is located away from a peripheral region of the top deck, to support a load positioned on a central region of the top deck wherein the stringer reinforcing member is fastened to the one of said stringer members extending under the inner region.

16. The metal pallet in accordance with claim 1 wherein each of the top deck members and/or the bottom deck members are profiled.

* * * * *